US005893425A

United States Patent [19]

Finkle

[11] Patent Number: 5,893,425

[45] Date of Patent: Apr. 13, 1999

[54] REMOTE CONTROL ELECTRIC POWERED SKATEBOARD

[76] Inventor: Louis J. Finkle, 148 7th St., Seal Beach, Calif. 90740

[21] Appl. No.: 08/684,634

[22] Filed: Jul. 22, 1996

[51] Int. Cl.[6] ..... A63C 5/08

[52] U.S. Cl. ..... 180/181; 180/180; 180/342; 280/87.042

[58] Field of Search ..... 180/180, 181, 180/342; 280/87.042; 301/5.3

[56] References Cited

U.S. PATENT DOCUMENTS 5,020,621 6/1991 Martin ..... 180/181

5,330,026 7/1994 Hsu et al. ..... 180/181

5,487,441 1/1996 Endo et al. ..... 180/181

*Primary Examiner*—Richard M. Camby

*Attorney, Agent, or Firm*—Edgar W. Averill, Jr.

[57] ABSTRACT

An electric powered skateboard having an electric motor which directly drives one of the wheels of the skateboard. The board is preferably controlled by a remote controller which smoothly accelerates the motor and also smoothly brakes the motor electrically. Preferably the direct drive is through a toothed belt and preferably a high torque/low RPM electric motor is used.

15 Claims, 6 Drawing Sheets

11
12
10
18
17

13
14
16
15
17
31
28
29
27
30
19
22
25
23
24
26
20

REMOTE CONTROL ELECTRIC POWERED SKATEBOARD

BACKGROUND OF THE INVENTION

The field of the invention is powered skateboards and the invention relates more particularly to electric powered skateboards.

Skateboards are a popular way for young persons to travel. Although there are some gasoline powered skateboards in use, the overwhelming use of skateboards is simply foot power. Electric powered skateboards have been very limited in range and have been hard to control. One such skateboard is shown in U.S. Pat. No. 5,020,621 where a remote controlled unit is used to turn on and off the electric motor which is connected to one of the rear wheels by an O-ring belt. The board has a brake which presses against the rear wheels and may be also controlled by a Bowden cable from the cable connected remote control device. A remote controlled electric skateboard is shown in U.S. Pat. No. 5,330,026 which utilizes an electric motor between two of the wheels of the skateboard. An electric motor is connected to the wheels by sun and planet gear units. An on/off power to the motor is provided by a remote control device. A one-way bearing allows the board to coast when the motor is turned off.

U.S. Pat. No. 5,487,441 shows a motorized skateboard which is controlled by a foot switch. It may be either driven by a drive wheel in the center or the rear wheels may be driven by a drive shaft and gear arrangement. Once again, the motor is provided with an on and off controller.

There are numerous difficulties with these approaches. Because an electric powered skateboard includes both a motor and batteries, it becomes a relatively heavy unit and means must be provided to stop the unit so that it does not constitute a safety hazard to bystanders if the user loses control. While the device of U.S. Pat. No. 5,020,621 has a Bowden cable controlled brake, the use of a cable interferes with the freedom of movement on the board. In the event the user falls off of the board it is very likely that the cable will be pulled out of the unit by the inertia of the board. A motor which is merely turned on causes a substantial battery drain as it starts and also tends to provide a somewhat abrupt start. The result are boards which are limited in range and very difficult to control.

BRIEF SUMMARY OF THE INVENTION

It is an object of the present invention to provide an electric skateboard which is easily controlled and has a long battery life.

The present invention is for an electric powered skateboard having a board with an upper rider support surface and at least four wheels. An electric motor is held by the board as are batteries and a motor control unit. A positive drive means is provided between the motor and at least one of the wheels. The motor control provides a slow controlled acceleration as well as a controlled braking action so that the board may be started in a controlled manner and also may be stopped in a controlled manner. Preferably the control is a remote control held by the rider and preferably the driven wheel is connected to the motor by a toothed belt. The motor is preferably a low speed permanent magnet motor having a maximum RPM of about 3,000. The controller preferably has a trigger which may be retracted to increase the speed and pushed away from the user to decrease the speed and increase the braking. In this way the rider can smoothly start the skateboard and smoothly stop the skateboard. Preferably there is a safety switch whereby the board will be stopped if there is no weight on the board and further, the board will stop in the event the controller is more than a fairly short distance, such as 6', from the board. In a preferred embodiment two electric motors are held in a single housing and drive two wheels on one of the trucks of the skateboard.

DESCRIPTION OF THE PREFERRED EMBODIMENTS

Figure 1:
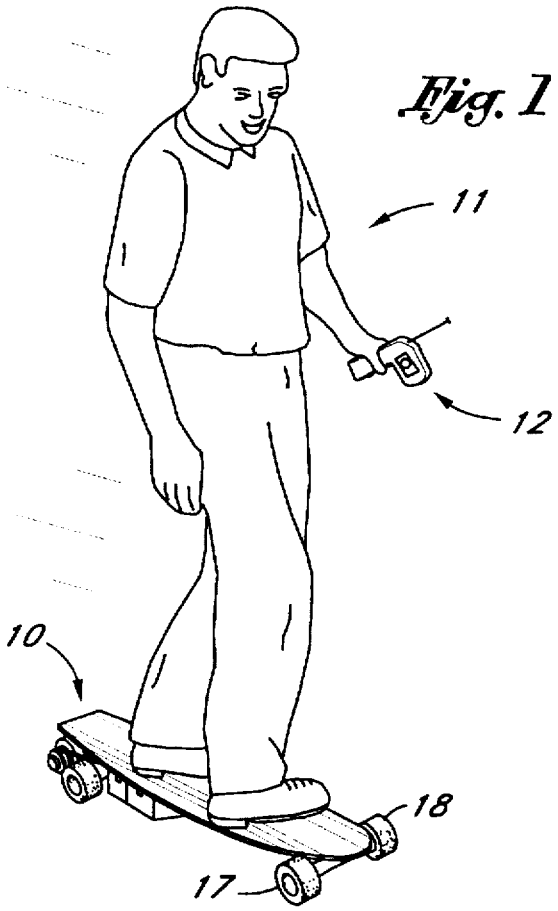
FIG. 1 is a perspective view showing the electric powered skateboard of the present invention propelling a rider.
Figure 2:
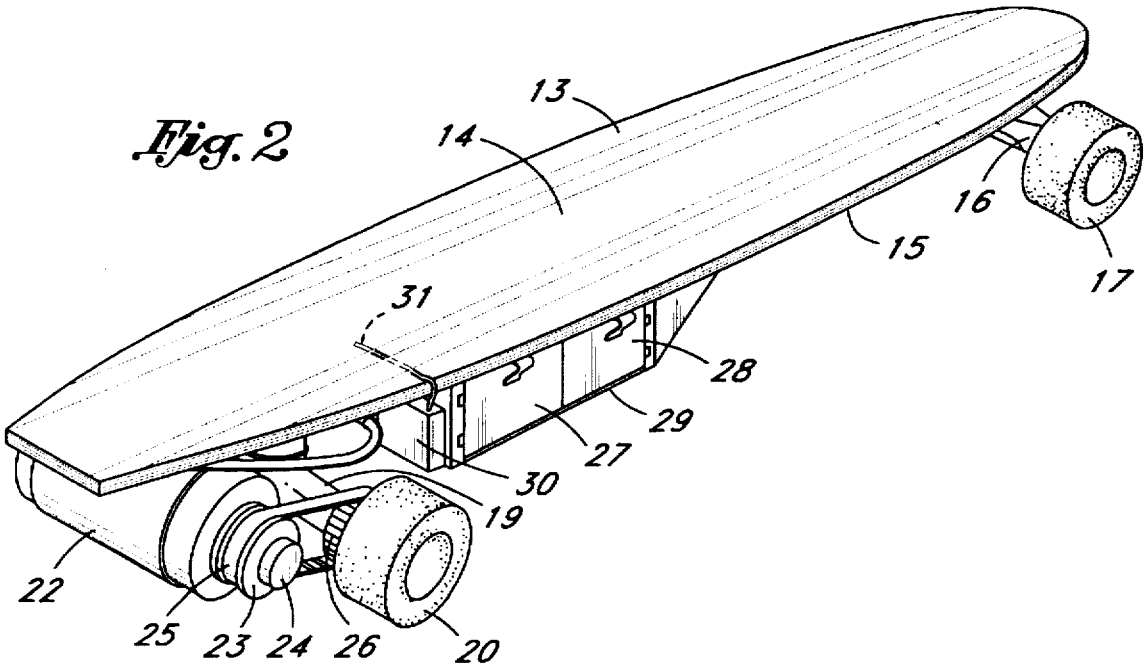
FIG. 2 is a perspective view of the electric powered skateboard of FIG. 1.
Figure 3:
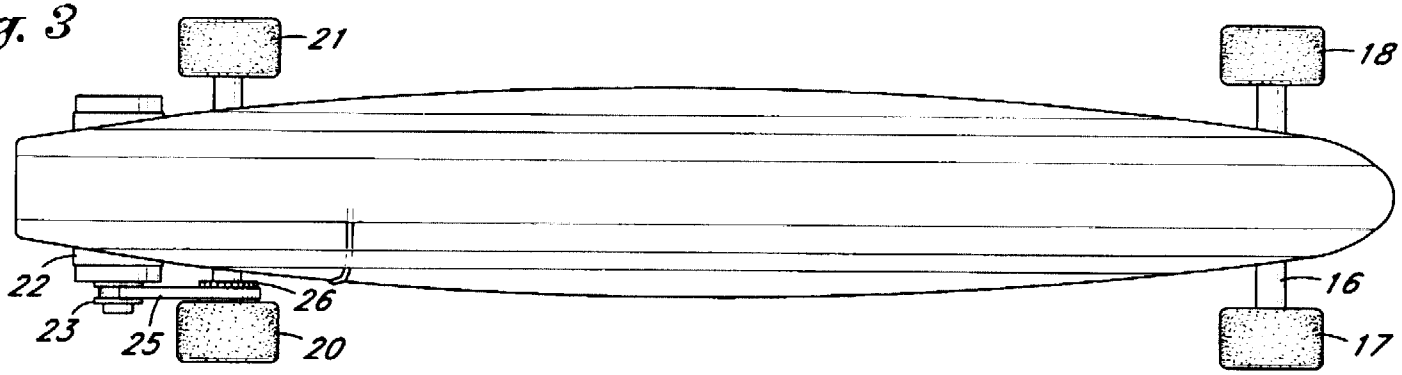
FIG. 3 is a top view of the electric powered skateboard of FIG. 1.

The electric powered skateboard of the present invention is shown in perspective view and indicated generally by reference character 10. Skateboard 10 is supporting a rider 11 holding a remote control unit 12. Skateboard 10 is shown in more detail in FIG. 2 where it can be seen that it has an upper plywood board 13 of a relatively conventional nature. Board 13 could, of course, be fabricated from other materials, such as glass filled polymer. Board 13 has an upper surface 14 and a lower surface 15. Lower surface 15 supports a front truck assembly 16 which in turn supports freely rotating wheels 17 and 18. A rear truck assembly 19 supports wheels 20 and 21.

Electric powered skateboard 10 is moved by an electric motor 22 which has a driven pulley 23 connected to the shaft 24 of the rotor. Pulley 23 is preferably a toothed pulley which drives a toothed drive belt 25. Toothed drive belt 25 also meshes with pulley 26 which is integral with wheel 20. That is, as pulley 26 rotates, wheel 20 rotates. This provides an important feature of the present invention and that is the braking capability permitted when motor 22 is electrically braked wheel 20 is provided with a direct braking force. This braking force is sufficient to stop an adult driver going at a speed of 25 mph in a space of about 10 feet. This provides a substantial amount of control to the rider. Furthermore, when the motor is a permanent magnet motor and the braking is a dynamic braking it actually charges the batteries to regain some of the power expended in acceleration. Also, such dynamic braking is not a simple turning off of motor 22 but instead is a controlled braking. Preferably a pulse width modulated speed control unit is used which provides a slow or fast but controlled acceleration as well as braking. Thus, the rider can by movement of the trigger of the remote control unit 12 accelerate the board and decelerate the board with complete control.

Figure 4:
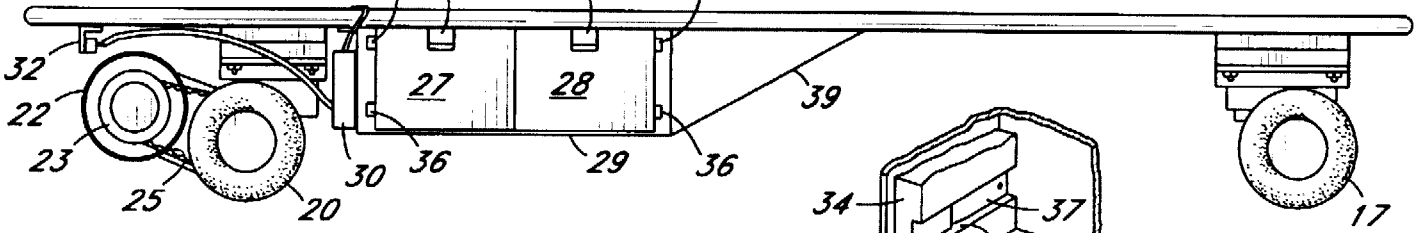
FIG. 4 is a side view of the electric powered skateboard of FIG. 1.

A pair of batteries 27 and 28 are held in a battery box 29. These batteries are preferably either sealed lead acid batteries or gel cell batteries. The batteries should be rechargeable. It has been found that when utilizing two 12V 9 amp hour batteries a distance of 7 miles between recharging can be achieved. Also, speeds up to 20 mph on level surface have been reached. p Electric powered skateboard 10 has receiver and motor controller unit 30 which has an antenna 31 for receiving signals from remote control unit 12. The batteries may be recharged by plugging a recharger into socket 32 shown in FIG. 4. The batteries of a prototype unit have been 12V batteries connected in series. Motor 22 of a prototype unit has been of the permanent magnet type and the motor is of a relatively low speed and high torque variety. In that way the motor can freely turn without any power. This is because there is essentially no gear reduction between the motor and the wheel. That is, pulley 23 is only 25% smaller than pulley 26. Thus, the user may get on the skateboard and start it up in a conventional manner by using one foot and then initiate the remote control unit 12 to accelerate.

Figure 4A:
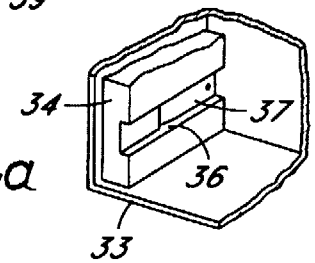
FIG. 4A is an enlarged perspective view of a portion of the battery box of the electric powered skateboard of FIG. 4.
Figure 5:
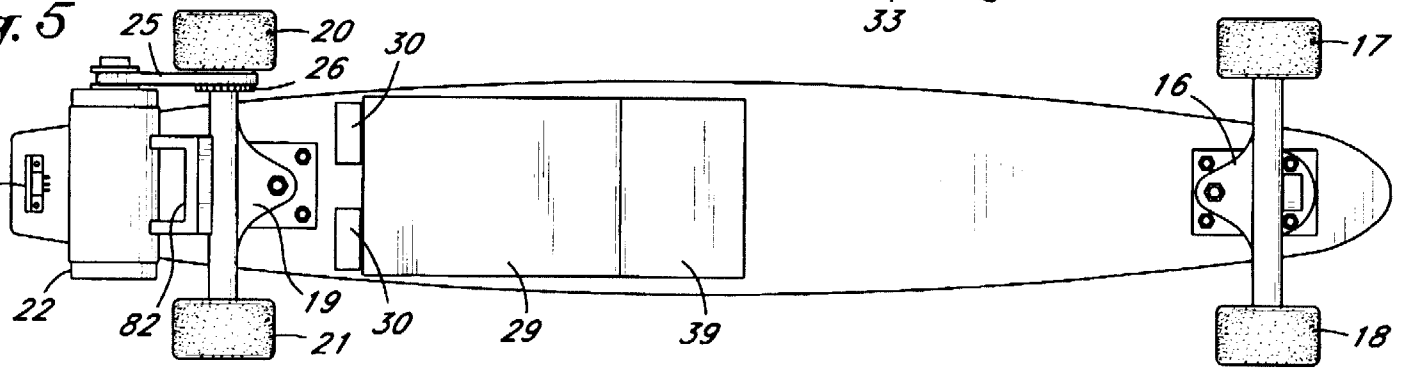
FIG. 5 is a bottom view of the electric powered skateboard of FIG. 1.

The method of holding the batteries in battery box 29 provides a uniquely effective way of making electrical contact, assuring proper polarity and making it easy to insert and remove the batteries. This detail is shown is FIGS. 4 and 4A where the metal battery box 33 has a polymeric block 34 on one side and a polymeric block 35 on the other side. Each block has two grooves 36 and each groove holds a tapered spring loaded beryllium copper strip 37 which is soldered or otherwise connected to a conductor in series. The batteries have protruding electrodes which make sliding contact with the beryllium copper strips. A pair of spring loaded retainers 38 hold the batteries in place. An angled front guard 39 helps prevent damage to battery box 29 in the event the battery box is struck with an obstruction.

Figure 6:
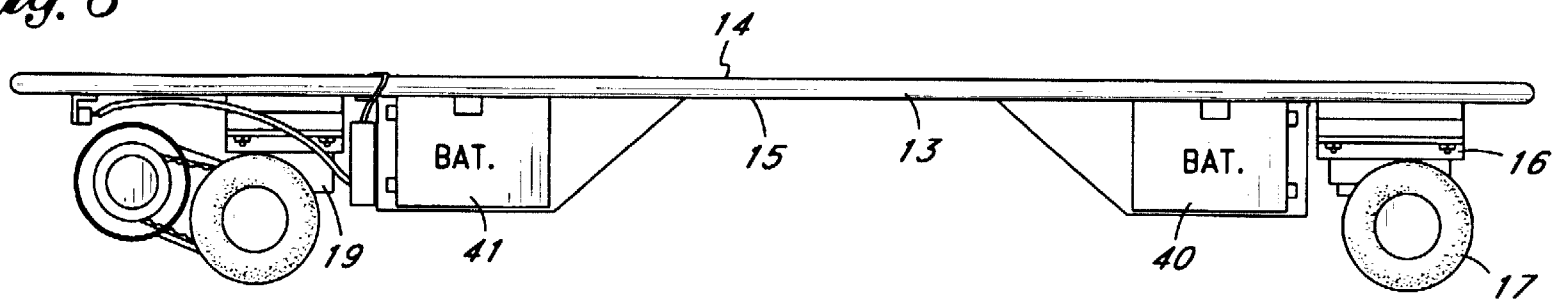
FIG. 6 is a side view of an alternate configuration of the electric powered skateboard of FIG. 1.
Figure 7:
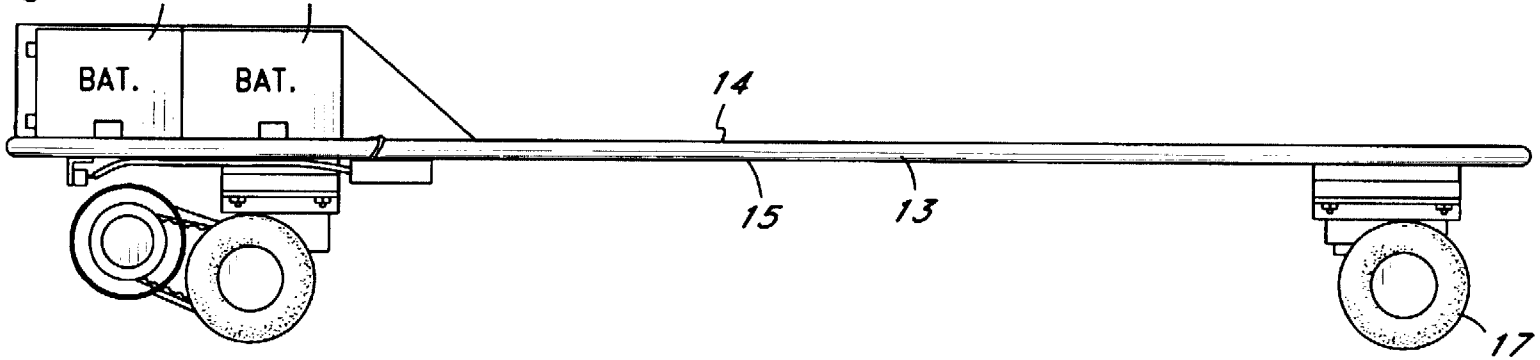
FIG. 7 is a side view of an alternate configuration of the electric powered skateboard of FIG. 1.
Figure 9:
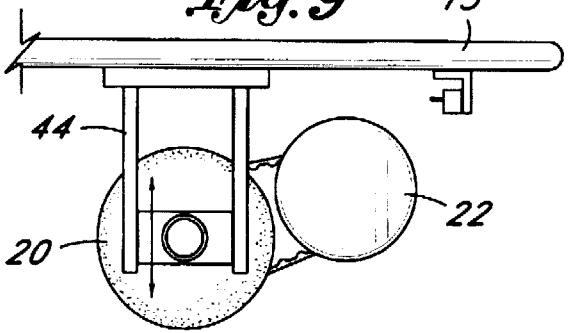
FIG. 9 is an enlarged side view of an alternate configuration of the motor support of the electric powered skateboard of FIG. 1.

FIGS. 6 and 7 show alternate configurations of battery location. Since the batteries are relatively heavy, their location is an important factor in the balance of the board. In FIG. 6, battery 40 is mounted near the front truck assembly 16 and battery 41 is mounted near the rear truck assembly 19. In FIG. 7, batteries 42 and 43 are mounted on the upper surface 14 of board 13.

Figure 8:
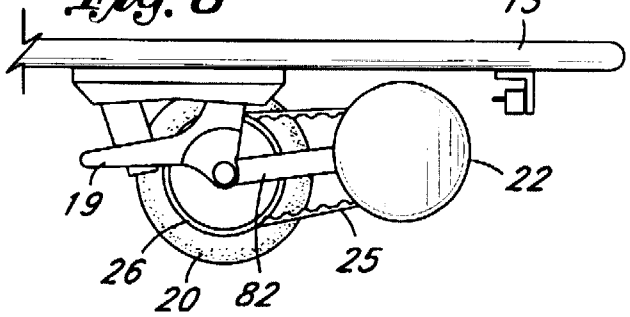
FIG. 8 is an enlarged side view of one of the trucks of the electric powered skateboard of FIG. 1.

FIG. 8 shows a cross-sectional view of rear truck assembly 19. This can be a relatively conventional skateboard truck assembly. These truck assemblies are mounted on an angle so that as the board 13 is tipped the pair of wheels connected to one truck assembly will turn guiding the skateboard in a right turn or a right lean and a left turn or a left lean in a conventional skateboard manner. Motor 22 is welded to a bracket 82 which, in turn, is affixed to rear truck assembly 19. By providing the skateboard control similar to that of conventional skateboards the conversion from a conventional skateboard to an electric powered skateboard is made easy. It is contemplated, alternatively, that the rear wheels may be mounted on a frame 44 which would be constructed to prevent any of the turning just discussed below of the rear wheel axle.

Since the drive shown in FIGS. 1 through 9 is only of one driven wheel 20, this, of course, tends to turn the rear truck assembly slightly as the motor 22 is accelerated or decelerated. This turning effect is eliminated by such rigid mounting.

Figure 10:
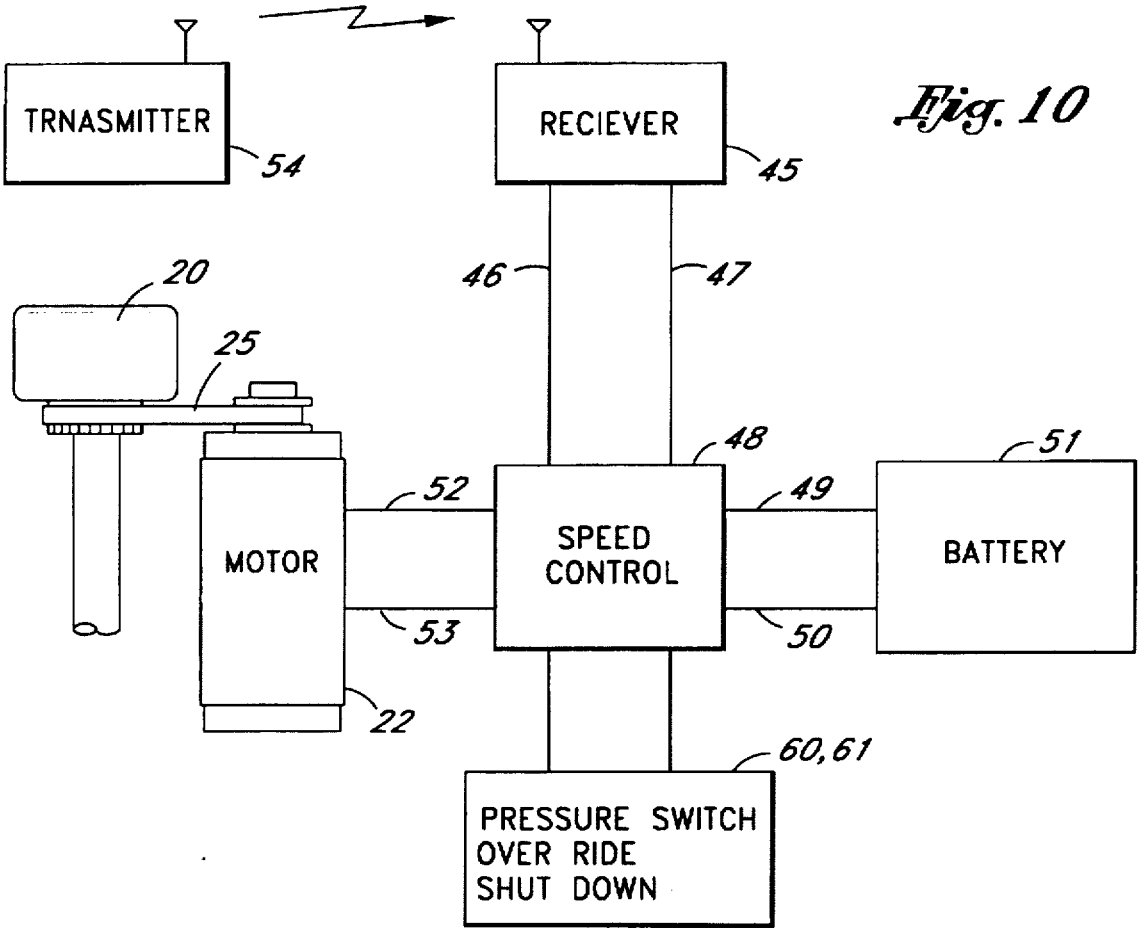
FIG. 10 is a diagrammatic view of the motor and motor control units of the electric powered skateboard of FIG. 1.

A block diagram of the elements of the motor control are shown in FIG. 10 where the receiver and speed controller 30 are broken down into a separate receiver 45 which is connected by a pair of conductors 46 and 47 to speed controller 48. Speed controller 48 receives input voltage through conductors 49 and 50 which are connected to the batteries 51. A pair of conductors 52 and 53 provide controlled voltage to motor 22. The transmitter 54 is part of the remote control unit 12 and provides a wireless signal to receiver 45.

Figure 11:
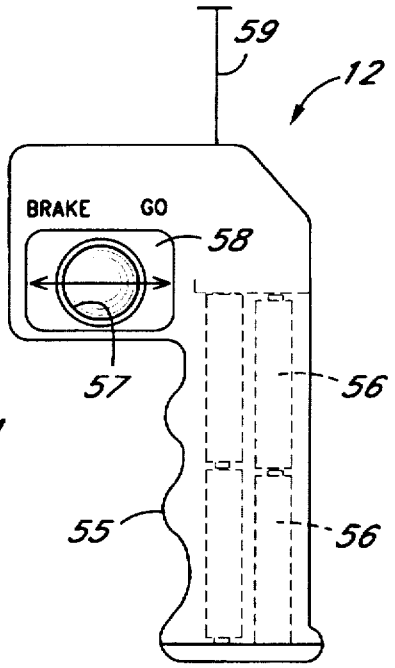
FIG. 11 is a side view of the remote control device of the electric powered skateboard of FIG. 1.

The remote control unit 12 is shown in side view in FIG. 11. Remote control unit 12 has a handle 55 which holds the batteries 56. A finger opening 57 is formed in a sliding block which in turn is connected to the transmitter 54 to provide an output signal through antenna 59. As the trigger or finger opening 57 is squeezed the transmitter transmits a signal to the receiver to increase the speed controller signal to motor 22. Conversely, when the trigger is pushed away from handle 55 toward the braking direction, the transmitter transmits a signal to the receiver which in turn causes the speed controller to dynamically slow down motor 22 and in a controlled manner to stop the skateboard. The speed controller and remote control unit are configured in such a way that as the block 58 is moved all the way toward the handle a maximum acceleration signal is sent and when it is only partially moved back toward the handle 55 only a slight acceleration signal is sent. Conversely, as the block 58 is moved forward from a center point, a slight amount of braking occurs and where the trigger is pushed all the way away from handle 55, the maximum amount of dynamic braking occurs.

Figure 12:
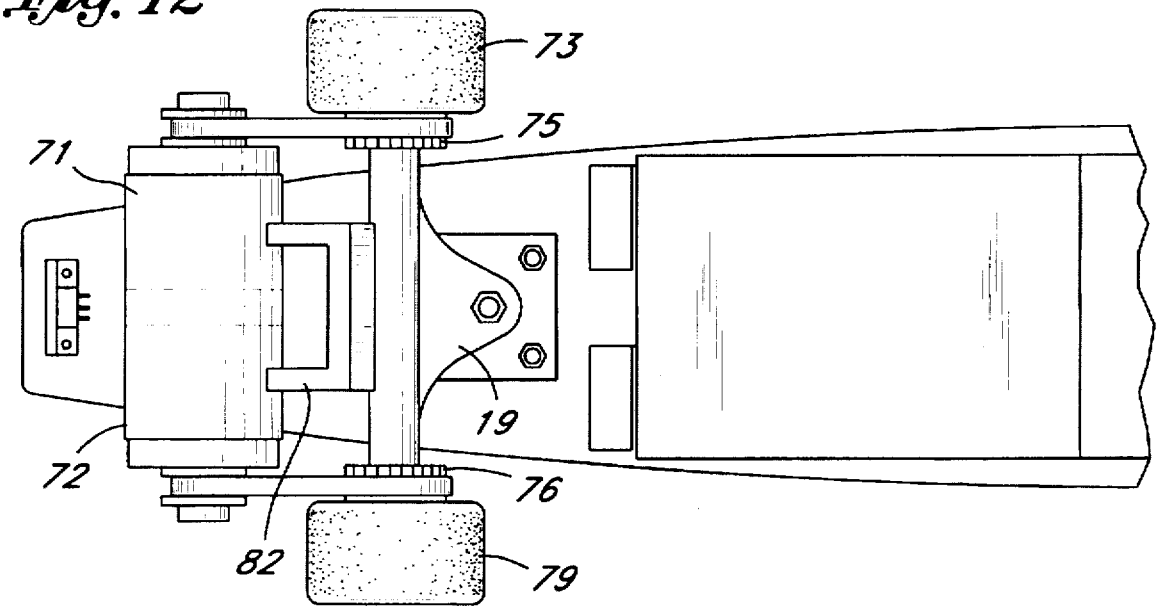
FIG. 12 is a bottom view of an alternate configuration of the electric powered skateboard of FIG. 1.
Figure 13:
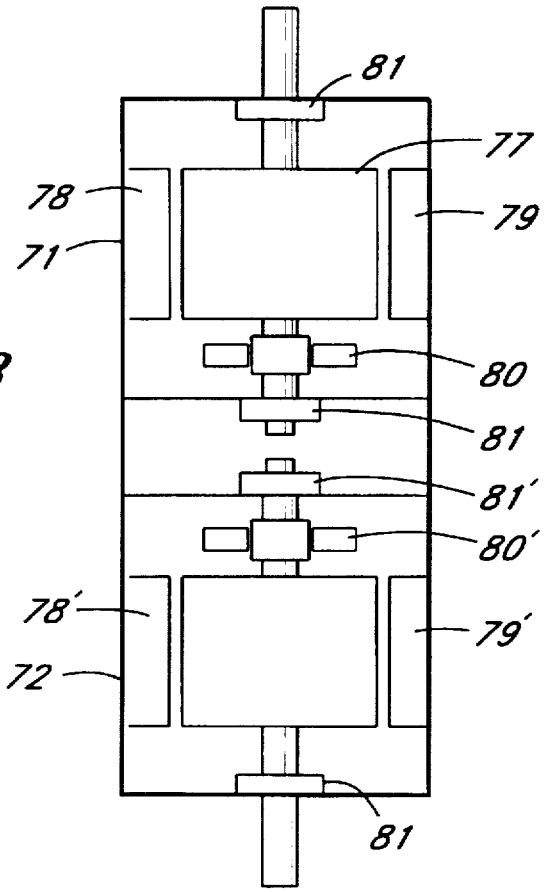
FIG. 13 is a diagrammatic view of the motor of the electric powered skateboard of FIG. 12.

In order to eliminate the slight driving and braking imbalance of the board of FIGS. 2 through 8, a pair of motors can be used such as motors 71 and 72 in FIG. 12. Both wheels 73 and 74 are driven wheels having toothed pulleys 75 and 76 respectively affixed thereto. By providing a pair of motors with their wire leads in series, the wheels 73 and 74 can turn at a slightly different rate which occurs during a turn and, thus, provides an electrical differential. Furthermore,during acceleration or braking, power is exerted on both wheels and any twist thrust is eliminated. The driving and braking actions are improved by the existence of two driven or braked wheels. As shown in FIG. 13, motor 71 has a rotor 77 and permanent magnets 78 and 79. Conventional brushes 80 and bearings 81 complete the diagrammatic view of motor 71. Motor 72 has the same features indicated with the same reference characters followed by a '. By this configuration no sort of gearing is required and a highly efficient direct driving and direct braking results.

Figure 14:
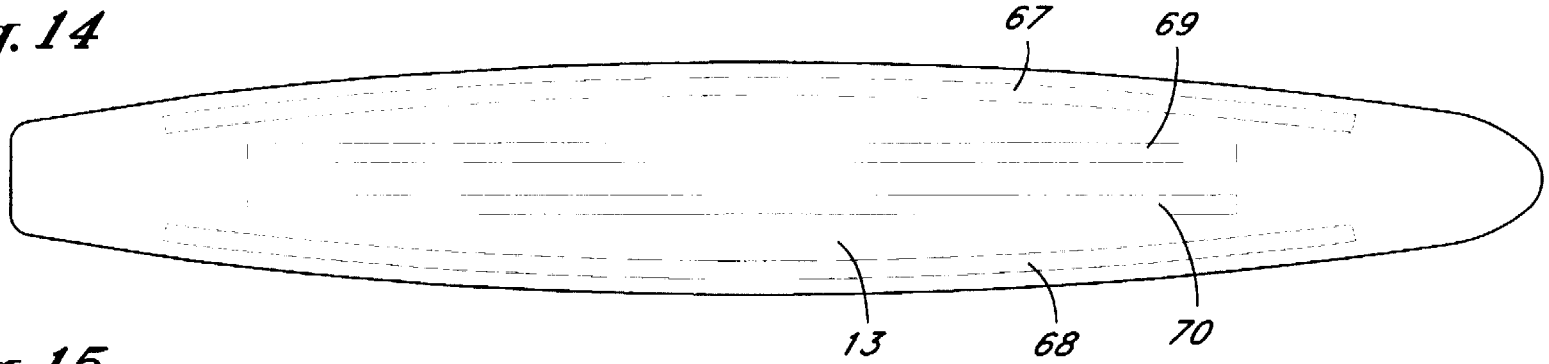
FIG. 14 is a top view of an alternate configuration of the electric powered skateboard of FIG. 1 showing a safety switch on the upper surface thereof.
Figure 15:
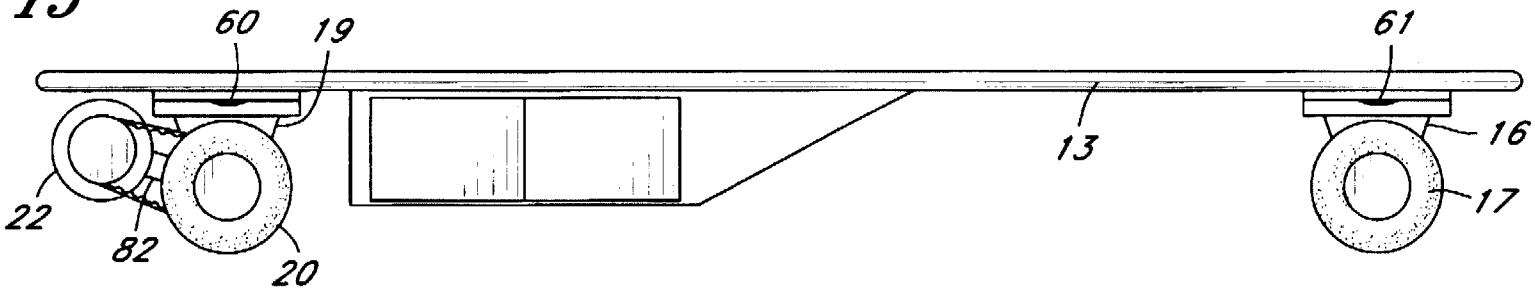
FIG. 15 is a side view of the electric powered skateboard of FIG. 1 showing a pair of pressure safety switches.
Figure 17:
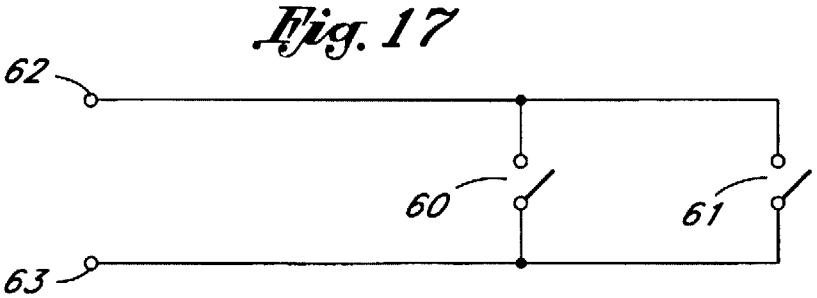
FIG. 17 is an electric circuit of the safety switch system of the electric powered skateboard of FIG. 15.
Figure 16:
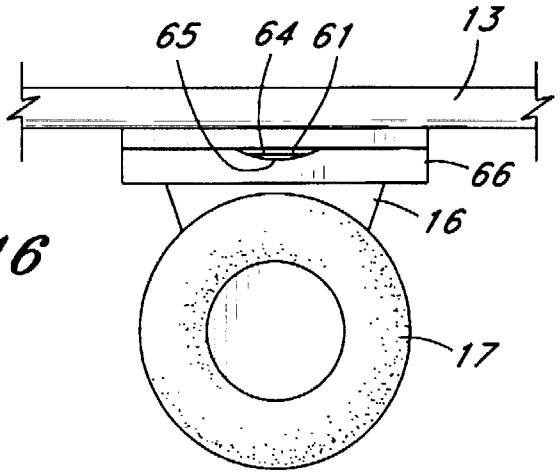
FIG. 16 is a cross-sectional view of one of the safety switches of the electric powered skateboard of FIG. 15.

The use of a safety switch is an important feature of the present invention. The circuit shown in FIG. 17 depicts switches 60 and 61. If either one of these switches is closed, the circuit is completed between points 62 and 63. These are integrated into the speed controller 48 so that the motor will not go if at least one of the switches is not closed. In FIG. 15 switch 61 is shown in front truck assembly 16 and switch 60 is shown in rear truck assembly 19. Thus, if there is a significant amount of weight on board 13 one of these two switches will be closed. The switch may be a pressure switch such as switch 64 in FIG. 16. Switch 64 is positioned in a depression 65 in a flexible polymeric block 66. It is important that there be a switch both at the front truck assembly 16 and the rear truck assembly 19 since a user's weight may be very far forward or very near the back in some maneuvers and the user would not wish the motor to turn off. An alternative method is shown in FIG. 14 where film switches may be positioned in strips 67, 68, 69 and 70 which would respond to the pressure of a user's feet. A further safety feature is the provision of a distance sensitive signal whereby the motor will receive a braking signal if the remote control unit is greater than about six feet from the motor control.

The result of the combination shown in the drawings is an electric powered skateboard of unusual practicality. It is easily controlled by the rider and a person that rides a skateboard can also ride the electric powered skateboard of the present invention. This is the result of its smooth acceleration and braking action which in turn is the result of the direct drive. High speed/low torque motors, while light in weight and low in cost, would require a substantial gearing down to provide an appropriate wheel rotation. This gearing prevents any practical coasting when the motor is not energized because the motor must turn at such a high RPM it is very difficult to move the wheels without providing electrical power. In stark contrast the low speed/high torque motor of the present invention can readily be pedaled without power.

The radio control unit is equipped with circuitry so that a particular remote control unit will only control one controller. The units will be serialized so that no two skateboards will respond to a given remote control unit.

While the radio control unit has been generally discussed herein other types of wireless controls could alternatively be used. Furthermore, a direct signal through a hard wire cable is readily possible. It is important that the signal from the remote control unit be unique so that the remote control unit of one user would not interfere with the remote control unit of another user.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An electric powered skateboard having a board with an upper rider-support surface and a lower surface supporting at least four wheels wherein the improvement comprises:

an electric motor held by said board;

battery means held by said board and connectable to said electric motor by motor control means;

remotely controlled drive means between said electric motor and at least one of said wheels, said at least one of said wheels being a driven wheel and said drive means being a positive drive means between said motor and said driven wheel and wherein said electric motor is controlled by a remote control unit having a moveable trigger capable of sending a variable, controlled acceleration signal and a variable, controlled braking signal dependent upon the position of the trigger and said electric motor includes motor control and receiver units to receive said variable, controlled acceleration signal and said variable, controlled braking signal and cause electric motor to accelerate or brake in a controlled manner; and braking means comprising electric motor braking to electrically impose a resistance to rotation on the motor thereby imposing a resistance to turning on said driven wheel.

2. The electric powered skateboard of claim 1 wherein the positive drive means is a toothed belt passing around a toothed pulley on said electric motor and around a toothed pulley on said driven wheel.

3. The electric powered skateboard of claim 1 wherein said motor is a permanent magnet direct current motor.

4. The electric powered skateboard of claim 1 wherein said remote control unit and said motor control and receiver units are pulse width modulated speed control units whereby the electric powered skateboard can smoothly accelerate and decelerate within the control of a rider by use of the remote control unit.

5. The electric powered skateboard of claim 1 wherein said remote control unit has a handle which supports two way trigger means contactable with a riders index finger and movable in an inner direction toward said handle to send an acceleration signal and in an outward direction away from said handle to send a braking signal.

6. An electric powered skateboard having a board with an upper riding surface, wheels and said board supporting a battery unit, a remote control signal receiver, an electric motor, a motor controller which receives signals from said remote control signal receiver permitting the variable, controlled acceleration and deceleration of said electric powered skateboard further comprising:

a low speed permanent magnet motor having a maximum RPM of about 3,000; and means for making a direct connection between a rotor of said motor and at least one wheel of said electric powered skateboard.

7. The electric powered skateboard of claim 6 wherein said low speed permanent magnet motor has a power of at least about three quarters of one horsepower.

8. The electric powered skateboard of claim 7 wherein said motor is a twelve volt motor.

9. An electric powered skateboard having a board with an upper riding surface, wheels, electric power means including a battery, an electric motor supported by said board and a motor speed controller, a signal receiver supported by said board, a remote control unit to be held by a rider, a direct drive between said electric motor at least one of said wheels and said motor having the ability to provide dynamic, variable, controlled braking and variable, controlled acceleration in response to a signal from said remote control unit and wherein there are safety means to brake the electric powered skateboard when the rider is not in control of the electric powered skateboard.

10. The electric powered skateboard of claim 9 wherein there are a pair of front wheels and a pair of rear wheels supported on an axle supported on a truck and each of said trucks is affixed to said board and wherein there is a pressure sensitive switch between each of said trucks and wiring means between said pressure sensitive switches and said electric power means so that when there is no weight on the board, both of the pressure sensitive switches are off and the motor will not operate.

11. The electric powered skateboard of claim 9 wherein at least one elongated safety switch is positioned on an upper surface of the board and said elongated safety switch is wired to said electric power means so that when there is no weight on the elongated safety switch, the motor will not operate.

12. The electric powered skateboard of claim 9 wherein said remote control unit will only operate within a discreet distance of no more than about six feet from the board so that if the rider falls off the board, the board will stop.

13. An electric powered skateboard having a board with an upper rider supporting surface, a lower surface, a pair of front wheels and a pair of back wheels, an electric motor including means to drive at least one of said wheels, motor control means further comprising:

a battery container supported under the lower surface of said skateboard, said battery container having a floor and two sides, at least one battery having two terminals extending from a side thereof, a pair of slots in one of the two sides of said battery container, a conductive element in a bottom of each of said slots and means for retaining said battery in said battery container whereby when said battery is slid into said battery container its terminals make electrical contact with the conductive elements.

14. The electric powered skateboard of claim 13 wherein there are two batteries.

15. The electric powered skateboard of claim 13 wherein said at least one battery is a twelve volt sealed lead acid battery.

* * * * *